US005808547A

United States Patent [19]

Carney

[11] Patent Number: 5,808,547

[45] **Date of Patent: *Sep. 15, 1998**

[54] INTRUSION ALARM AND DETECTION SYSTEM

[76] Inventor: William P. Carney, 4 High Ridge La., Oyster Bay, N.Y. 11771

[ * ] Notice: The term of this patent shall not extend beyond the expiration date of Pat. No. 5,621,385.

[21] Appl. No.: 786,371

[22] Filed: Jan. 16, 1997

Related U.S. Application Data

[63] Continuation-in-part of Ser. No. 506,420, Jul. 24, 1995, Pat. No. 5,621,385.

[51] Int. Cl.[6] ..... G08B 13/00

[52] U.S. Cl. ..... 340/541; 341/176; 340/426

[58] Field of Search ..... 340/541, 573, 340/528, 527, 539, 692, 693, 426; 341/176; 364/709.15, 709.16

[56] References Cited

U.S. PATENT DOCUMENTS 5,621,385 4/1997 Carney ..... 340/541

*Primary Examiner*—Jeffery Hofsass

*Assistant Examiner*—Albert K. Wong

*Attorney, Agent, or Firm*—Charles E. Temko

[57] ABSTRACT

An intrusion detection system used to surveil a predetermined space includes a monitor disposed within the space and a remote controller. The monitor comprises an intrusion detector for sensing an intruder in the space and a memory circuit having an armed and a disarmed state recording any sensed intrusion. The remote controller includes an RF transmitter activated by a button switch the pulsed closure of which either arms or tests or disarms the monitor. When arming the monitor, a first audible or visual output is produced by the monitor in response to the RF pulse which switches it from the disarmed to the armed state. In the armed state, the monitor produces a second audible or visual output in response to the RF pulse which is used to test the state of the monitor. The second response is easily distinguished from the first response by a user. If an intrusion occurs, the monitor produces an alarm signal. While the monitor is sounding the alarm signal, a pulsed closure of the button switch disarms the monitor. Should the monitor detect an intrusion and/or be disabled by the intruder, the lack of the monitor output in response to the RF pulse transmitted by the remote controller warns the user, before entering his or her premises, there exists the possibility of confronting an intruder.

8 Claims, 3 Drawing Sheets

INTRUSION ALARM AND DETECTION SYSTEM

CROSS REFERENCE TO RELATED APPLICATION

This is a Continuation-in-Part of U.S. patent application Ser. No. 08/506,420 filed Jul. 24, 1995 now issued as U.S. Pat. No. 5,621,385.

BACKGROUND OF THE INVENTION

1. Field of the Invention

This invention relates generally to alarm systems and more particularly to an intrusion alarm and detection system which monitors a predetermined space, initiates an alarm as a result of an intrusion into the predetermined space and records the occurrence of the intrusion. The system includes a reliable and substantially foolproof means by which to remotely arm, disarm and test for the occurrance of the intrusion without causing a false test report because a user inadvertently arms a disarmed system or disarms an armed system.

2. Description of Related Art

Burglar alarm systems which detect unauthorized entries into protected premises such as houses or apartments and produce audible or visual alarm signals as a result of such entries are well known. Automobile and personal property alarms which are remotely armed, disarmed and tested are also known in the art.

Typical house protection systems produce an audible or visual alert to warn occupants that an intrusion is occurring. If occupants are not at home, the alarm may or may not notify neighbors or police of a break-in. House alarm systems usually stop signalling after a predetermined period of time and, should no one respond to the alarm, occupants reenter their premises unaware of the possibility of confronting a remaining intruder.

For apartment buildings and other types of multiple occupancy dwellings, sonic burglar alarms are normally limited by local regulations to relatively short alarm time periods to avoid the nuisance of false alarms in densely populated premises. In small one or two room apartments, an intruder can easily find a concealed alarm in the process of producing an alert and quickly disable it. Neighbors may not hear the alarm and, even if they do, may not bother to inform the returning occupant of the break-in. The returning occupant enters his or her apartment not knowing that an intruder may be in their premises.

Remotely controlled automobile alarm systems are generally connected to a car's electrical system and utilize its horn and head lamps as alarm signals to discourage theft. Generally, a returning car owner is not as concerned about a remaining intruder as, for example, a returning apartment occupant since an intruder in an automobile can be observed by the owner before the owner reenters the vehicle whereas an intruder may remain unseen in an apartment.

The following United States Patents show prior art alarm systems of the type to which the present invention is applicable:

U.S. patent application, Intrusion Alarm and Detection System, Ser. No. 08/506,420 filed Jul. 24, 1995 teaches a novel alarm system which monitors a predetermined space, initiates an alarm as a result of an intrusion into the predetermined space and records the occurrence of the intrusion. The system comprises an infrared sensor for detecing the intrusion and a memory circuit which is switched from an armed state to a disarmed state for recording the intrusion. The system includes a reliable and substantially foolproof means by which to remotely arm, disarm and test for the occurrence of the intrusion without causing a false test report because a user inadvertently arms a disarmed system or disarms an armed system. A signalling protocol is disclosed which includes activating a single button remote control for a predetermined duration in order to arm the system and activating the remote control for a duration less than the predetermined duration in order to test the system. This application does not, however, teach a signalling protocol wherein the system may be either armed, or tested or disarmed in a substantially foolproof and reliable manner by employing only a momentary pulse of the remote control button.

U.S. Pat. No. 4,794,368, which issued to Edward Grossheim and Michael Nykerk on Dec. 27, 1988 teaches an alarm system having three RF channels and a hand-held remote controller with three button switches. Pressing any one of the three buttons once or pressing any combination of the three buttons simultaneously controls up to seven distinct functions. Grossheim's disclosure does not address the problem of the user misusing the remote controller, thus, creating a false test response. False reports in systems such as Grossheim's may occur as a result of either the user pressing the wrong button or wrong combination of buttons or buttons being accidentally depressed. A false status report is a significant problem affecting the safety of the user particularly if the surveiled space is not visible to a returning occupant. Grossheim does not solve the problem of providing a user with a substantially foolproof system having a monitor controlled by a single button remote which arms, disarms, and tests the monitor for a remaining intruder in the user's premises.

U.S. Pat. No. 4,897,630, a continuation-in-part of U.S. Pat. No. 4,794,368, which issued to Michael Nykerk on Jan. 30, 1990 discloses a computerized alarm system for detecting, signalling and reporting the occurrence of a penetration toward or an unauthorized entry into a defined area, such as an automobile. It also discloses a self-contained monitor intended to protect a variety of objects such as a boat, a trailer, a house, etc. and which communicates with a remote controller in a similar manner as taught in U.S. Pat. No. 4,794,368. Nykerk discloses a four button, four channel system wherein pressing any button once or pressing any combination of the buttons controls up to sixteen separate functions. A system which relies on selecting one of several buttons and pressing it once, or selecting a specific combination of buttons and pressing them simultaneously, to prompt a specific system response is expensive to manufacture and difficult to use particularly if the returning occupant has to operate the remote controller in a dimly lit or dark environment. Further, Nykerk discloses a system wherein an intruder is frightened away by a series of synthesized voice alarms but does not address the problem of an intruder remaining undetected in the surveiled space because the remote controller was misused thereby producing an incorrect test response.

U.S. Pat. No. 5,469,151 which issued to Patrick Lavelle on Nov. 21, 1995discloses an automobile alarm system which includes a single button remote controller wherein when the button is pressed once it arms the system and when pressed again it disarms the system. Lavelle does not teach a system comprising a single button remote controller which may be used to arm, disarm and test the monitor. Further, Lavelle does not teach a system which may be used to surveil an enclosed space such as an apartment providing a returning occupant a substantially foolproof means by which to remotely detect an unobserved intruder secreted in the apartment.

U.S. Pat. No. 5,473,305, which issued to Shih Hwang on Dec. 5, 1995 teaches an automobile alarm system which includes a single button remote controller wherein the system is armed and disarmed by a single pulse of the button. When the system is sounding an alarm, the single pulse of the button only stops the sounding and the alarm remains armed. Finally, the alarm is completely disarmed when the vehicle owner activates the remote control twice consecutively. Hwang's disclosure does not teach a system which enables a user to test for a remaining unobserved intruder.

As can be seen from the prior art, alarm systems for protecting automobiles, houses and apartments are complex, expensive and depend on various alarm schemes to frighten away would-be intruders. Existing systems do not specifically address the problems associated with self-contained intrusion detection monitors which are disposed to monitor spaces which cannot be seen by the system operator. In such applications, existing remotely controlled systems do not solve the problem of a returning occupant inadvertently either pressing the wrong button or combination of buttons and erasing the record of an intrusion or pressing the wrong button or combination of buttons and arming a disarmed system thereby causing a false report resulting in an encounter with an intruder.

It is apparent that there is a need for a cost-effective remotely controlled system which includes a minimum number of commercially available components, which consumes a minimum amount of electrical power and which can be integrated in a compact housing for convenient placement in an area to be surveiled. In addition, a system is needed that may be purchased and installed, for example, by an average apartment dweller, which is remotely controlled by a method that is easy to use, and substantially foolproof and which operates in a manner such that a returning occupant has a reliable method by which to test for a remaining intruder.

SUMMARY OF THE INVENTION

The present invention provides a novel intrusion detection and alarm system that is easy to install and which enables a returning occupant to determine, with a high degree of reliability, if his or her premises has been broken into before reentering the premises thereby avoiding an unwanted encounter with an intruder.

The present invention is an improved intrusion detection system of the type in which an intrusion is detected by a monitor having an RF receiver, a power supply, an intrusion detector, a logic circuit, a memory circuit and a responder. The monitor is disposed to surveil a predetermined space and the monitor has an armed state and a disarmed state and a user employs a hand held remote controller to arm and disarm the monitor.

The improvement comprises the remote controller having a button switch for generating a pulse signal under the control of the user. The monitor is armed by the pulse signal and indicates that it has been switched from the disarmed state to the armed state by responding to the pulse signal with a first response. The state of the monitor is tested by the pulse signal from the remote controller and indicates that it is in the armed state by responding to the pulse signal with a second response. The first response and the second response are distinguishable from each other so that the user may remotely determine the status of the monitor by transmitting the pulse signal and by noting the response of the monitor. The monitor is selectively disarmed by either the pulse signal from the remote controller when the responder is responding or the sensing of a power interruption by the logic circuit.

DETAILED DESCRIPTION OF THE PREFERRED EMBODIMENT

Figure 1:
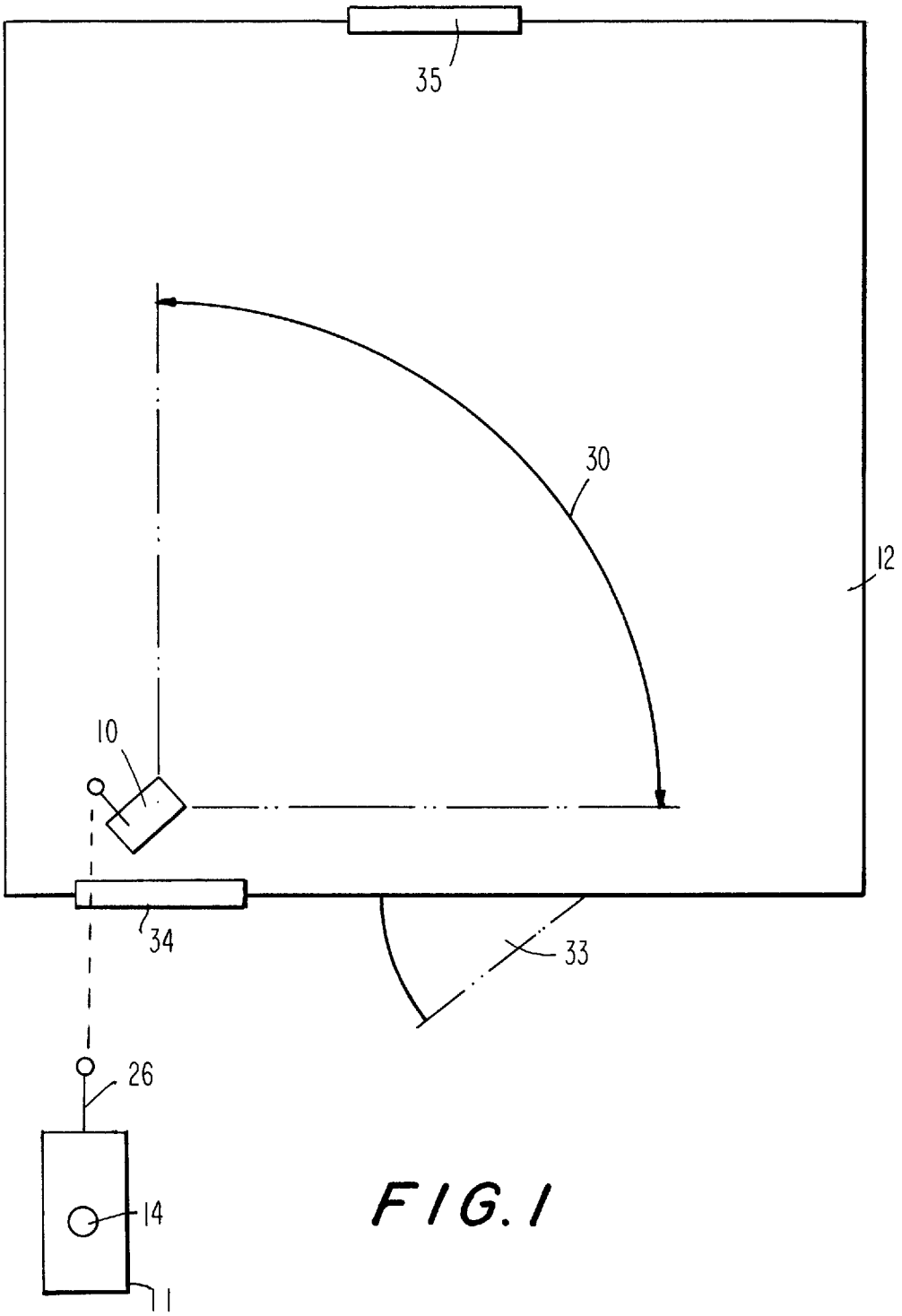
FIG. 1 is a plan view of the intrusion monitor disposed to surveil a premises. Also included in this figure is the remote controller.

Referring now to the drawings, FIG. 1 shows a view of the intrusion detection system used to monitor a typical predetermined space 12 for an intrusion. The space 12 includes a door 33 and may or may not include additional openings such as a front window 34 and a rear window 35 depending on the particular premises in which the system is deployed. The system comprises a remote controller 11 and a monitor 10. The remote controller 11 may be hand held, includes a button switch 14, and remotely controls the monitor 10 by transmitting a radio-frequency (RF) signal to the monitor 10. The monitor 10 is disposed within the predetermined space 12 and, as will be described in more detail below, is armed, disarmed, and tested by the RF signal received from the remote controller 11 initiated by a user pressing the button switch 14. When armed, the monitor 10 produces an alarm response if the predetermined space 12 is intruded. In addition, the monitor records and may be tested for the intrusion.

It is well known that monitors such as the monitor 10 described herein occasionally do not respond to every press of the remote controller button switch 14. Ambient electromagnetic interference, environmental conditions and other factors may result in the monitor 10 randomly failing to respond. Because of this phenomenon, users are generally uncertain as to whether the remote controller actually communicates with the receiver each time the remote is activated. For example, a remotely controlled garage door may not open the first time its associated remote controller button is pushed. In this case, the user repeatedly presses the remote until the door opens. The present invention, described hereinafter, employs a signalling arrangement wherein the monitor 10 is remotely armed, remotely tested and remotely disarmed by a substantially foolproof signalling protocol. One of the features of this foolproof signalling arrangement is that it prevents the user from either inadvertently arming a disarmed system or disarming an armed system because of the aforementioned tendency by the user to repeatedly press the remote when he or she is not sure whether the monitor 10 has received the transmitted signal.

In the present invention, feedback from the monitor 10 notifies the user that his or her pressing of the button switch 14 has actually initiated a successfully transmitted and received RF signal. The feedback reports to the user the exact status of the monitor 10. For example, upon being switched from the disarmed state to the armed state, the monitor 10 responds with a distinctive prolonged (preferably 5 to 7 seconds) first response signal indicating that it has been armed. Once armed, the monitor 10 responds to the RF signal with a short (preferably 1 to 2 seconds) second response signal indicating that it is in the armed state. Finally, if the monitor 10 is producing the above mentioned alarm response, it reacts to the RF signal by ceasing to respond thereby notifying the user that it has been disarmed.

It is important to note that the user knows by the response from the monitor 10 the result produced by his or her last press of the button switch 14. When testing the system, the user may repeatedly press the button switch 14 realizing that unless the monitor 10 produces the first response, it has not been inadvertently armed. Further, the user knows that as long as he or she does not press the button switch 14 while the monitor 10 is producing any response, the system cannot be inadvertently disarmed.

The monitor 10 surveils the predetermined space 12, produces the alarm signal when an intruder enters its detection pattern 30 and records an occurrence of the intrusion. The detection pattern 30, as shown in FIG. 1, is representative of detection patterns provided by typical commercially available intrusion detectors such as the detector used in the monitor 10. The memory status of the monitor 10 is tested through the use of the remote controller 11 to remotely determine if the monitor 10 is armed to detect and record the intrusion or if the intrusion has been detected and has been recorded. If the monitor 10 is armed and no intrusion has been recorded, a momentary closure or pulse of the button switch 14 on the remote controller 11 causes the monitor 10 to produce an output signal such as a visible light or an audible sound indicating that it is safe to enter the predetermined space 12. If the intrusion has been recorded by the monitor 10, or if the intruder destroys, mutes, disables, interrupts power to, or removes the monitor 10 from the predetermined space 12, a momentary closure or pulse of the test button switch 14 results in no response from the monitor 10 indicating by lack of an output signal that it may not be safe to enter.

The type of output signal, visual or audible, created by the monitor 10 and the location of the monitor 10 within the space 12 are at the user's discretion and depend on the layout of the premises in which it is disposed. A house may include the front window 34 and the rear window 35 making it convenient to position the monitor 10 near the front window 34 so that a visual output signal is easily observed by a returning occupant through the front window 34. An apartment in a multiple occupancy dwelling may not include the front window 34 and, in this premises, the monitor 10 may be disposed at a strategic location within the apartment such that an audible output signal is heard by a returning occupant through the door 33. Because the monitor 10 is lightweight and compact, a security conscious traveller may easily employ the system of the present invention to ensure that it is safe to reenter a motel room after returning from a late night supper. Individual travellers are often concerned about coming back to a motel room late at night, particularly if the room they rented was the only one available when they checked in and it is located with easy access to the public and/or is near a highway. Given such a location, it is important that the intrusion detection system provide the user a foolproof method of operation which permits repeatedly testing the state of the system in a noisy and/or dark environment without concern of inadvertently misusing the remote controller 11. What follows is a description of an embodiment of the present invention which provides a substantially foolproof system.

Figure 2:
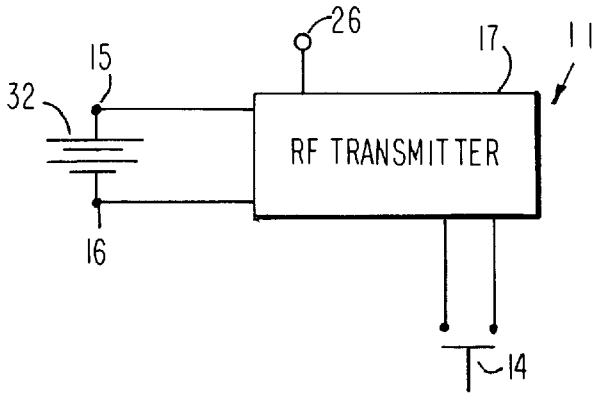
FIG. 2 is a schematic block diagram of the electrical circuit employed in the remote controller.

As shown in FIG.1 and FIG. 2, the remote controller 11 includes a power supply such as a battery 32 which supplies a DC potential across its terminals 15 and 16 providing power to the RF transmitter 17 equipped with an antenna 26. The remote controller 11 is a commercially available one channel transmitting device that operates in a manner similar to a garage door remote having a button switch the depression of which causes an RF signal to be sent to a receiver in order to open a garage door. Off-the-shelf units are supplied with circuit means that enable the system manufacturer to tune the transmitter and receiver to the same radio frequency. The remote transmitter 17 of the present invention preferably transmits the RF signal for as long as the button switch 14 is held closed.

As will be described in more detail below, the user of the remote controller 11 of the present invention employs a signalling protocol which either arms, or disarms or tests the monitor 10 by a single pulse of the button switch 14 wherein the length of the pulse is not critical. The user is notified as to which function the single pulse has initiated by different responses generated by the monitor 10. The signalling protocol includes, first, pulsing the switch 14 for a short time period (a momentary closure of preferably 1 to 2 seconds duration) which causes a pulse signal to be transmitted to the monitor 10. If the monitor 10 is disarmed, its detection pattern 30 is not being intruded and the monitor 10 is not producing an alarm signal, the pulse signal arms the monitor 10. After releasing the button switch 14, the monitor 10 produces the first response indicating that it is armed. Alternatively, the button 14 may be held closed until the system produces the first response. In either mode, the first response notifies the user that he or she has armed the monitor. The first response is preferably a distinctive signal which is easily recognized by the user. For example, it may be either a prolonged (preferably 5 to 7 seconds) buzzing sound or a prolonged intermittent beeping sound. If the detection pattern 30 is being intruded, the system will fail to arm as a result of the pulse signal and in order to arm the system, the intrusion must be cleared.

Second, an armed system is tested by pulsing the switch 14 thereby causing the pulse signal to be transmitted to the monitor. If the monitor 10 is armed, it responds with the second response which is easily distinguished from the first response. For example, the second response may be a single short beep, preferably 1 to 2 seconds.

Third, while the monitor 10 is in the process of producing the aforementioned alarm response, the user may disarm the system by pressing the remote button switch 14 once during the response. In other words, the monitor 10 is disarmed by the pulse signal consisting of a momentary RF pulse generated by the user while the monitor 10 is in the process of responding.

To summarize, when the monitor 10 is disarmed, it may be armed by pulsing the button switch 14, tested at any time by pulsing the button switch 14 and disarmed by pulsing the button switch 14 while the monitor 10 is producing the alarm response. Unlike the prior art, the user of the present invention simply pulses the button switch 14 on the remote controller 11 to arm, or disarm or test the monitor. In the prior art, the user arms, disarms and tests the system by either selecting and pressing individual buttons from a plurality of buttons, or by selecting and pressing a combination of buttons from a plurality of buttons or by activating a single button for a predetermined duration of time.

In the present invention, the user pulses the button switch 14 and is notified by different signals from the monitor 10 as to the status of the monitor 10. As previously described, if the pulse of the button switch 14 has caused the monitor 10 to switch from the disarmed to the armed state, the monitor 10 responds with the distinctive prolonged buzzing or beeping sound. If the monitor is in the armed state, it responds to the pulse of the button switch 14 with the short beep. Finally, if the monitor 10 is producing the alarm response, the response may be stopped by pulsing the button switch 10.

The following is an illustration of how an apartment dweller may use the aforementioned signalling arrangement. When leaving his or her apartment, the departing occupant stands outside and pulses the button switch 14 causing the monitor 10 to provide the prolonged response indicating that it has been switched from the armed to the disarmed state. Should the departing occupant wish to double-check system status, he or she can repeatedly pulse the button switch 14 to test the monitor 10 without concern that his or her last press of the button 14 on the remote controller 11 has disarmed the system since the only way the system may be disarmed is by pulsing the button 14 while the monitor 10 is responding.

When returning, the occupant remotely tests the system by a momentary closure of the switch 14. The lack of an output signal from the monitor 10 indicates that there has been an intrusion and it may not be safe to enter the premises. Given this lack of a response, the returning occupant is immediately alerted to a questionable system condition. Because there was no response from the monitor 10, the user knows that he or she has not changed the status of the system while attempting to test it. Having been alerted to a possible intrusion, the returning occupant may double check the results by pulsing the button switch 14 again. Should there be no response, the returning occupant should seek help knowing the system has been violated.

Upon returning, if the monitor 10 produces the prolonged response as the result of pulsing the switch 14, the user is thereby notified that during his or her absense, the monitor 10 was switched from the armed to the disarmed state. Given this prolonged response, the returning occupant is signalled that a break-in may have occurred and help should be summoned before reentering the premises.

The short beep output signal from the monitor 10, as a result of pulsing the switch 14, indicates there has not been an intrusion and it is safe to enter. When the returning occupant enters his or her apartment and triggers the monitor, the alarm response may be turned off, as explained above, by the user pressing the remote button 14 while the monitor 10 is in the process of responding.

Figure 3:
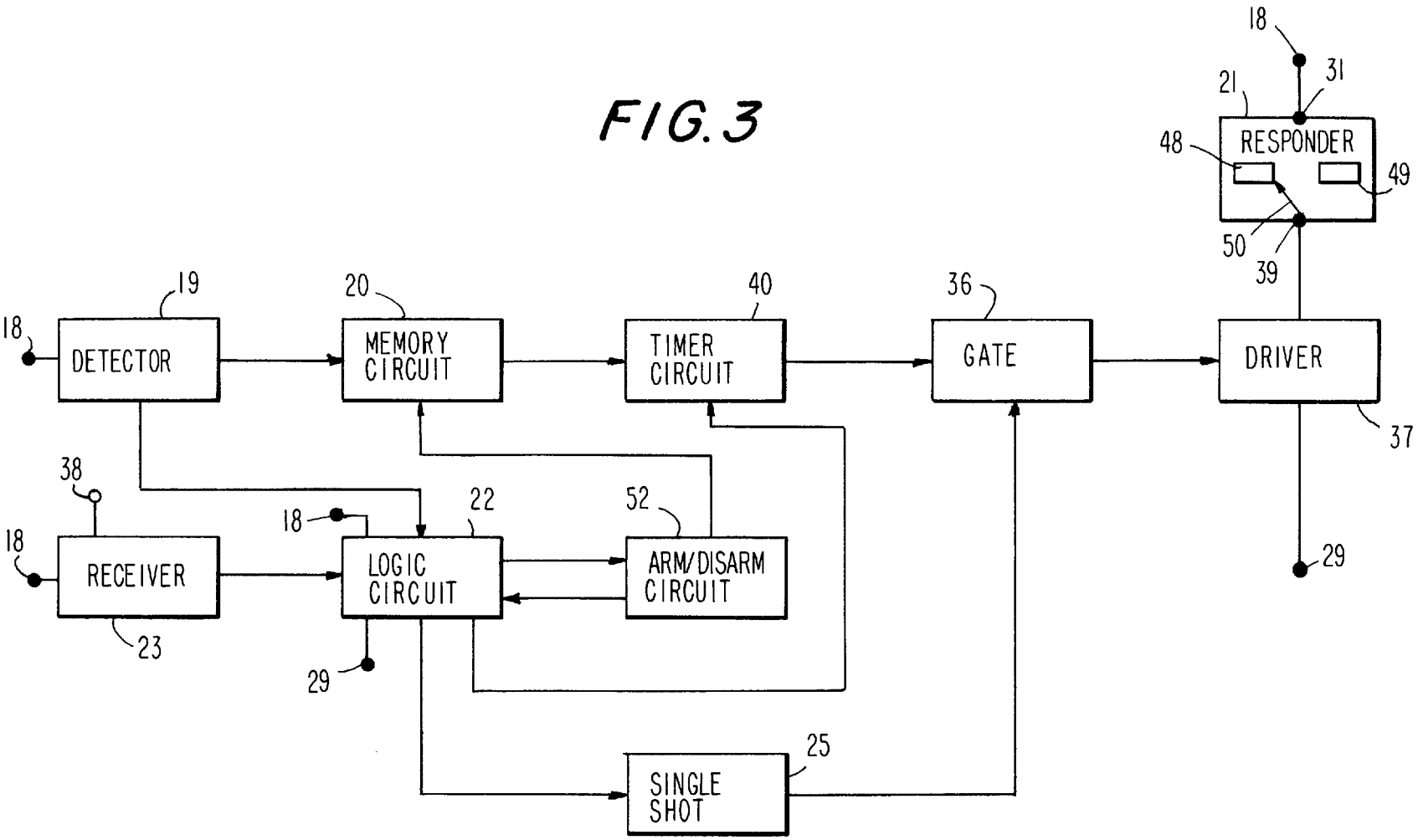
FIG. 3 is a schematic block diagram of the electrical circuit employed in the intrusion monitor.

As shown in FIG. 1, FIG. 2 and FIG. 3, the circuit of monitor 10 is equipped with a power supply such as a battery or an A.C. power line transformed and rectified to supply a D.C. potential across its positive terminals 18 and ground terminals 29. An RF receiver 23 is a commercially available one channel receiving device which, as previously described, operates in substantially the same manner as the receiver in a garage door opener system. The functions of a logic circuit 22, a memory circuit 20, an arm/disarm circuit 52, a timer circuit 40, a single shot 25, a gate 36 and a driver circuit 37 are preferably integrated as part of a commercially available 8051 micro controller chip, or equivalent, produced by any one of a number of solid state integrated circuit manufacturers such as Intel or Fujitsu. The logic circuit 22 senses the status of the devices that are connected to it and, as explained below, depending on the status of these devices, creates electrical signals directing one or more of them to react. An intrusion detector 19, a commercially available passive infrared device, detects an intrusion of an individual into its detection pattern 30 which causes its normally closed contacts to open. A responder 21 having commercially available signalling components, a buzzer 48 and a light 49, selectable through a switch 50, provides either the audible alarm and audible test signals or the visual alarm and visual test signals in response to an electrical current flow in the monitor circuit between circuit points 31 and 39.

The circuit of monitor 10 is armed by the pulse signal transmitted by the RF transmitter 17 initiated by the closure of the button switch 14. This closure causes a set of normally open contacts in the RF receiver 23, equipped with an antenna 38, to close for as long as the button switch 14 is held closed by the user. Logic circuit 22 notes this closure and tests the state of the detector 19 and the state of the arm/disarm circuit 52. If the normally closed contacts in the detector 19 are closed and if the arm/disarm circuit 52 is disarmed, the logic circuit 22 arms the monitor 10 by initiating an electrical arm/disarm signal which arms the arm/disarm circuit 52 and arms the memory circuit 20. Immediately upon release of the button switch 14, the logic circuit 22 directs the responder 21 to produce the distinctive prolonged buzzing or beeping signal thereby notifying the user that the monitor 10 is armed. Alternatively, the logic circuit 22 senses when the memory circuit becomes armed and directs the responder 21 to produce the response, thus notifying the user that the monitor 10 is armed. In either case, once armed, the status of the monitor 10 may be tested, at any time, by a pulsed closure of the button switch 14. When the memory circuit 20 is tested by the pulsed closure of the switch 14, the RF receiver 23 is activated by the pulsed RF signal generated by the RF transmitter 17. The RF receiver 23 responds to this signal by a pulsed closure of its normally open contacts. The logic circuit 22 senses this pulsed closure and checks the status of the arm/disarm circuit 52. If the arm/disarm circuit 52 is armed, the logic circuit 22 initiates an electrical test signal which activates the single shot 25 thereby sending an electrical pulse through the gate 36 to the driver 37 causing current to flow in the responder 21. The selector switch 50 directs this electrical current flow between circuit points 39 and 31 through the buzzer 48 or the light 49 producing either an audible or a visual response of predetermined duration depending on the time setting of the single shot 25.

When an intrusion is detected, the normally closed contacts in the detector 19 open causing a power interruption to the logic circuit 22 thereby disarming the memory circuit 20 which in turn triggers the gate 36 causing a current of predetermined time duration, preferably set at between 1 to 5 minutes, to flow in the responder 21. The timer circuit 40 times this signal and stops current flow after the predetermined alarm time. After an intrusion has occurred, the monitor 10 will not produce a response to the test RF signal transmitted by the remote controller 11 because the memory circuit 20 has been switched to its disarmed state. The lack of an output in response to the test RF signal transmitted by the remote controller 11 is an indication that an intrusion has occurred.

The user can turn off the responder 21 and disarm the monitor 10 during the alarm response or the test response by a pulsed closure of the button switch 14. This pulsed closure of the button switch 14 causes a pulsed closure of the normally open contacts in the RF receiver 23. The logic circuit 22 senses this pulsed closure and if it also senses that the timer circuit 40 has been activated, the logic circuit 22 generates an electrical disarm signal which disarms the monitor 10 thereby stopping the current flow in the responder 21.

Should an intruder break into the premises and not be frightened away by the alarm being sounded by the monitor 10 as a result of the break-in and quickly note the location of the monitor 10 and interrupt or remove power across its terminals 18 and 29, the logic circuit 22 senses this power interruption and disarms the arm/disarm circuit 52. Once the arm/disarm circuit 52 is disarmed, it can only be rearmed, as explained above, by a unique signal initiated by a pulsed closure of the button switch 14. Without a remote controller tuned to the unique frequency required to activate the receiver 23, an intruder cannot rearm the system and fool a returning occupant into believing an intrusion has not occurred.

It is to be understood that the present invention is not limited to the precise details of structure shown and set forth in this specification, for obvious modifications will occur to those skilled in the art to which the invention pertains.

What is claimed is:

1. An improved intrusion detection system of the type in which an intrusion is detected by a monitor having an RF receiver, a power supply, an intrusion detector, a logic circuit, a memory circuit, and a responder, and in which said monitor is disposed to surveil a predetermined space, and in which said monitor has an armed state and a disarmed state and a user employs a hand held RF remote controller to arm and disarm said monitor, wherein the improvement comprises:

said remote controller having a button switch for generating a pulse signal under the control of said user;

said monitor being armed by said pulse signal from said remote controller;

said monitor indicating it has been switched from said disarmed state to said armed state by responding to said pulse signal with a first response;

said state of said monitor also being tested by said pulse signal from said remote controller;

said monitor indicating it is in said armed state by responding to said pulse signal with a second response;

said second response being distinguishable from said first response thereby indicating said armed state of said monitor; and said monitor being selectively disarmed by said pulse signal from said remote controller when said responder is responding and the sensing of a power interruption by said logic circuit.

2. The improved intrusion detection system according to claim 1 wherein said pulse signal is transmitted by a momentary closure of said button switch.

3. The improved intrusion detection system according to claim 2 wherein said momentary closure is less than two seconds.

4. The improved intrusion detection system in accordance with claim 1 wherein said first response is a five to seven second buzzing sound.

5. The improved intrusion detection system in accordance with claim 1 wherein said first response is a five to seven second beeping sound.

6. The improved intrusion detection system in accordance with claim 1 wherein said second response is a one to two second buzzing sound.

7. The improved intrusion detection system according to claim 1 wherein said power interruption is caused by said intrusion detector detecting said intrusion.

8. A method for operating an intrusion detection system, in which said detection system comprises a remote controller and a monitor, said remote controller having a button switch, said monitor including a memory circuit having an armed and a disarmed state, said controller remotely arming, disarming and testing said memory circuit, said monitor having means for detecting and reporting an intrusion in a predetermined space, said method comprising the steps of:

a. arming said self-contained monitor by a momentary closure of said button switch thereby producing a first response from said monitor indicating said monitor has been armed;

b. testing said state of said monitor by a momentary closure of said button switch thereby producing a second response from said monitor indicating said monitor is armed;

c. monitoring said predetermined space to detect an unauthorized entry;

d. triggering said monitor from said armed state to said disarmed state in response to said unauthorized entry;

e. testing for an intrusion by a momentary closure of said switch to obtain said second response from said self-contained monitor when said intrusion has not occurred; and f. disarming said self-contained monitor by a momentary closure of said button switch while said responder is responding.

* * * * *